United States Patent [19]

Klinkel

[11] Patent Number: 4,738,287

[45] Date of Patent: Apr. 19, 1988

[54] TUBULAR BAG FILLING MACHINE

[75] Inventor: Wolfgang Klinkel, Bigorio, Switzerland

[73] Assignee: Ilapak Research & Development S.A., Lugano, Switzerland

[21] Appl. No.: 21,337

[22] Filed: Mar. 3, 1987

Related U.S. Application Data

[63] Continuation-in-part of Ser. No. 830,640, Feb. 18, 1986, abandoned.

[30] Foreign Application Priority Data

Feb. 18, 1985 [CH] Switzerland ..... 739/85

[51] Int. Cl.[4] ..... B65B 3/16; B65B 1/16; B65B 9/10

[52] U.S. Cl. ..... 141/114; 141/67; 53/551; 53/511; 406/106; 406/88

[58] Field of Search ..... 141/67, 1, 5, 10, 114, 141/98; 406/88, 89, 91, 137, 106, 138, 93, 94; 53/551, 554, 511, 433

[56] References Cited

U.S. PATENT DOCUMENTS

| | | | |
|---|---|---|---|
| 1,061,429 | 5/1913 | Wallbillich | 406/88 |
| 1,546,360 | 7/1925 | Bates | 141/10 X |
| 1,746,395 | 2/1930 | Herdemerten | 406/137 |
| 2,527,466 | 10/1950 | Townsend et al. | 406/89 |
| 3,231,144 | 1/1966 | Rouanet et al. | 406/137 X |
| 3,265,098 | 8/1966 | O'Neal et al. | 141/5 |
| 3,302,979 | 2/1967 | Rollins et al. | 406/91 |
| 3,384,134 | 5/1968 | Hilleras | 141/10 |
| 3,694,037 | 9/1972 | Feder | 406/106 |
| 3,761,134 | 9/1973 | Hurd | 406/88 |
| 3,788,368 | 1/1974 | Geng et al. | 141/67 |
| 3,809,438 | 5/1974 | Hubbard | 406/106 |
| 4,033,535 | 7/1977 | Fong | 366/101 |
| 4,212,331 | 7/1980 | Benatar | 141/67 |
| 4,301,880 | 11/1981 | Krambrock et al. | 141/67 |
| 4,437,453 | 3/1984 | Metz | 53/551 X |
| 4,478,262 | 10/1984 | Auer | 141/114 |
| 4,501,109 | 2/1985 | Monsees | 53/451 |
| 4,532,753 | 8/1985 | Kovacs | 53/451 |

FOREIGN PATENT DOCUMENTS

| | | | |
|---|---|---|---|
| 1208514 | 1/1966 | Fed. Rep. of Germany | 141/67 |
| 2531036 | 2/1984 | France . | |
| 2495102 | 6/1984 | France . | |
| 624606 | 3/1959 | Italy | 406/91 |
| 527250 | 10/1940 | United Kingdom | 406/137 |
| 1115224 | 5/1968 | United Kingdom | 406/91 |
| 2061856 | 5/1981 | United Kingdom | 406/88 |

OTHER PUBLICATIONS

IBM Technical Disclosure Bulletin, Hebert, vol. 18, No. 11, 4–1976.

*Primary Examiner*—Henry J. Recla
*Assistant Examiner*—Ernest G. Cusick
*Attorney, Agent, or Firm*—Frishauf, Holtz, Goodman & Woodward

[57] ABSTRACT

To fill low-weight, high-volume goods, such as potato chips, popcorn and the like into bags as the bags are being made, the fill goods are introduced into a hopper and a filling funnel which is joined to a fill tube. The fill tube has air inlet openings at the upper portion, air outlet openings at the lower portion, and then continues to a holder and bag-forming tube. A film (102), for example, of plastic, is wrapped about the bag forming tube (105), and seamed vertically, so that the tube is being made as goods are introduced into the hopper and funnel. An air stream (B) is generated longitudinally in the fill tube (103) by introducing air under above-atmospheric pressure into the upper air inlet openings (104) formed as downwardly directed flap nozzles (119), the air being removed from lower openings (122) and, for example, recirculated in the recirculating blower (107), the openings being closed off outwardly by a jacket forming respective air inlet and outlet chambers (111,116). The fill goods are accelerated downwardly, while being prevented from "dancing" above the introduced air by the volume of the fill goods themselves within the hopper or inlet funnel (101). The bag is formed by usual vertical bag seaming apparatus (131) and cross-seamed, pinched and severed by filling and pinching jaws (113).

10 Claims, 4 Drawing Sheets

TUBULAR BAG FILLING MACHINE

The present application is a continuation-in-part of application Ser. No. 830,640, filed Feb. 18, 1986, now abandoned.

Reference to related application by the inventor hereof, and assigned to the Assignee of the present invention: U.S. application Ser. No. 830,641, U.S. Pat. No. 4,713,047 filed Feb. 18, 1986, Klinkel, and U.S. application Ser. No. 006,623 filed Jan. 22, 1987, the disclosures of which are hereby incorporated by reference.

The present invention relates to a bag filling machine and more particularly to a machine to fill limp tubular bags, for example plastic bags, with fill goods by gravity, in which the fill good is light and may not fall straight.

BACKGROUND

Bag filling machines which are arranged vertically frequently receive a tubular plastic bag structure which is pinched off at the bottom portion to form a bottom closure for the bag, the top of the bag being secured around a filling tube which expands, upwardly, into a filling funnel, through which the products to be filled into the bag are introduced. After filling, the bag is permitted to drop down, and the top of the bag is pinched off with a dual pinch or weld seam, the lower portion of the pinch or weld seam forming the seal for the just filled bag and the upper portion the bottom for a next bag to be filled.

Light filling goods or products are difficult to fill that way, or require an excessively large bag, since the fill good, upon dropping down through the funnel, may not fall straight, and be subjected to floating due to air resistance and planing effects. Typical fill goods which are light and of large areas are, for example, potato chips, popcorn and the like. Such large-surface light products have the tendency to "dance" in uncontrollable manner within the filling tube or the filling funnel, and to drop only slowly. It is absolutely necessary that the fill good is entirely within the bag and clearly below the seam line to be produced in closing the bag. This is necessary for safety and hygenic reasons. Thus, no portion of the product may fall within pinching jaws which seal off the top of the tube. The slowness of filling reduces the rate of machine output and the excess space in the fill bag requires additional material.

THE INVENTION

It is an object to improve the output rate of a vertical tubular filling machine, by increasing the rate of filling, and thereby to increase the machine output, without danger of plugging of the machine or of improper fill and thus interference with a bag sealing machine.

Briefly, a filling funnel is provided into which the goods to be filled are introduced. Downstream of the filling funnel, an essentially vertical, cylindrical tube is provided which has an air inlet chamber formed at an upper region and an air outlet chamber at a lower region. The respective chamber are in airflow communication with the interior of the essentially vertical tube, and are coupled to receive air over-pressure and remove air from the tube, so as to generate an essentially vertically directed airflow. The air inlet openings are formed by punching inwardly and downwardly directed lips out from the wall of the essentially cylindrical tube. The air outlet openings may be formed by a mesh, punch openings, or the like. The air may be circulated, for example, by a circulating pump connected to the chambers. A continuous air stream, thus, is provided which accelerates and directs the fill goods to a bag forming tube about which a limp material, typically plastic foil, is wrapped. The foil is seamed longitudinally, to form a tube which is pinched off at the bottom by pinching jaws which, for example, may travel vertically in a reciprocating motion to pull the bag, as it is being formed from the sheet, and as it is being filled downwardly, and to, later, re-pinch an upper portion of the tube, while, simultaneously, severing the thus closed and pinched upper portion from a pinched seal formed at further material, to form the bottom of a subsequent bag.

The arrangement is particularly suitable for filling such goods which are light, but of large surface, and have a tendency to "dance" when subjected to an airflow or air stream, such as potato chips, popcorn, and the like.

The funnel, and the essentially vertical tube in which the goods are prevented from dancing, while being transported towards the bag, as it is being formed, by the downwardly directed air stream are usually circular in cross-section. The air directing nozzles, as well as the removal openings, are preferably located circumferentially around the essentially vertically directed tube, which may form a cylindrical extension of a conical filling funnel.

The arrangement has the advantage that the air stream or airflow passing through the extension tube beyond the filling funnel generates a force component in vertical direction. This avoids turbulence, and substantially increases the packaging capacity of the machine. The throughput rate, thus, is improved. "Dancing" of the articles to be filled in the filling funnel region is avoided.

The structure of the invention can readily be combined with an existing bag forming machine, so that entire reconstruction or redesign of the bag manufacturing machine is not needed. Existing bag manufacturing machines can readily be modified in accordance with the invention, thereby increasing the output of existing machines with only minor modifications. The arrangement, thus, provides for a combined bag forming or manufacture-and-packaging unit. By introducing the air into the tubular extension downstream of the filling funnel, the goods are already constrained within an essentially cylindrical structure, so that they will not be blown away or outwardly of a filling funnel but, rather accelerated immediately towards the bag which is being made, as it is being filled.

DRAWINGS

DETAILED DESCRIPTION

Figure 1:
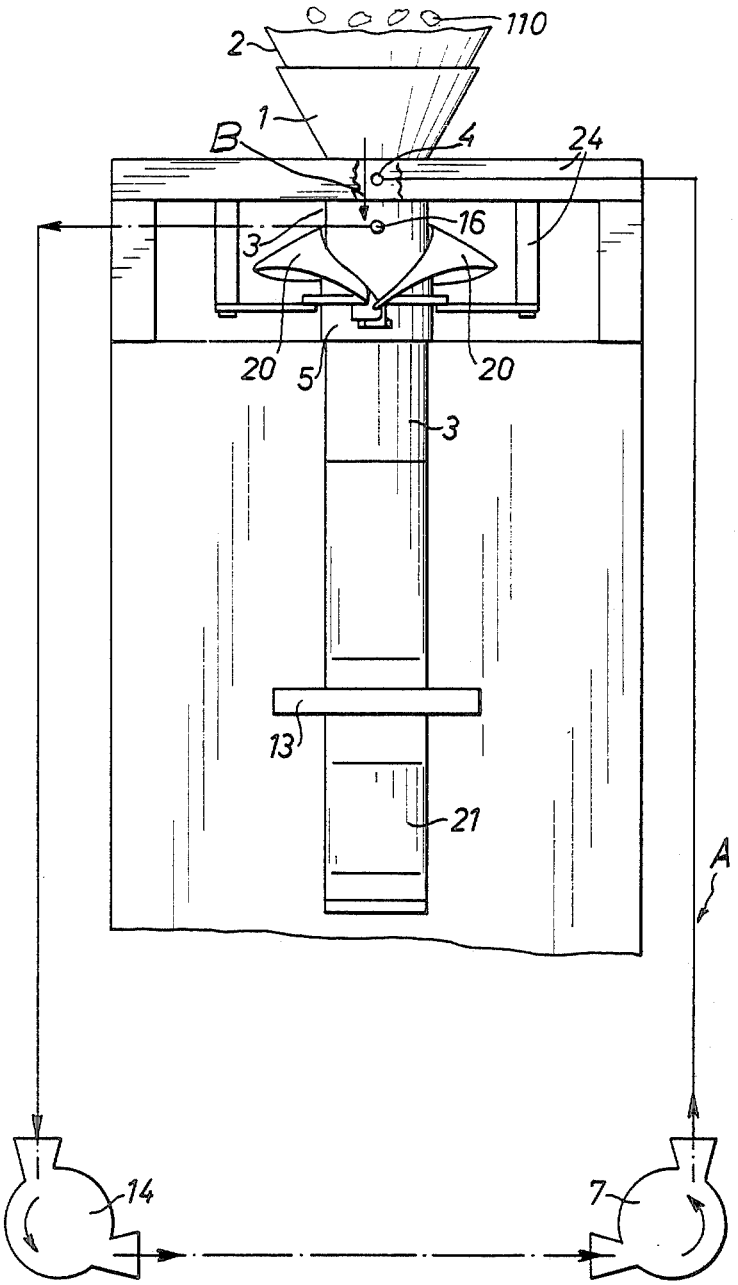
FIG. 1 is a highly schematic view of the filling portion of a tubular bag making-and-filling apparatus, and illustrating the system of the present invention.

Referring first to the general schematic arrangement, shown in FIG. 1: a metering device—not shown—provides fill goods 110 (FIG. 2) in needed quantities to a filling hopper 2 (FIG. 1) which directs the fill goods into a filling funnel 1 of a vertical tubular bag making-and-filling machine. The tubular bag making machine can be of any standard and well-known construction; in accordance with a preferred embodiment, the bag is being made as it is being filled, and reference is made to copending application Ser. No. 006,623, filed Jan. 22, 1987, assigned to the Assignee of this application. This construction permits, simultaneously, making a bag and filling it.

The filling funnel 1 directs the metered, for example weighed, fill goods 110 into an essentially cylindrical, vertical elongated extension 3. The extension or filling tube 3 is connected to a bag forming tube 5 about which a limp sealable material, for example polyethylene film or the like, is wrapped by a bag making machine. The limp material is sealed vertically by a vertical seaming apparatus 13 and shown generally in FIG. 2 at 131, which may be of any standard and well-known construction or, preferably, constructed as described in detail in the aforementioned referenced application Ser. No. 006,623 filed Jan. 22, 1987. The seaming apparatus 131 can reciprocate vertically, as schematically shown by arrow 132, and as described in more detail in the referenced application Ser. No. 006,623 filed Jan. 22, 1987. As the plastic foil is wrapped about the bag making the tube 5, for example by forming 20 sheets or vanes 20, shown in FIG. 2 at 120, the then parallel vertical edges, which may overlap, are seamed by the seaming apparatus 131. The bottom of the tube is pinched off by pinch jaws 113 which have an intermediate knife. Thus, when the seal jaws 113 close, as is well known in bag manufacturing technology, the jaws will seal the upper edge of a just-formed bag, the lower edge of a new bag to be formed, thus defining a bottom wall therefor, and sever the just-formed bag from the lower edge of the new one which is being made by the formation of the bottom wall. The filled bag 21 (FIG. 1) or, in FIG. 2, 121 can then be dropped off into a suitable container.

In accordance with the present invention, air is supplied by an air communication loop A from a blower 7 to an inlet chamber 4, which provides air to the fill tube 3. Air is removed from the fill tube 3 through outlet 16, for example by a suction blower 14, which can be integrated in a single unit with the blower 7, to generate a vertical air stream B within the fill tube 3.

Figure 2:
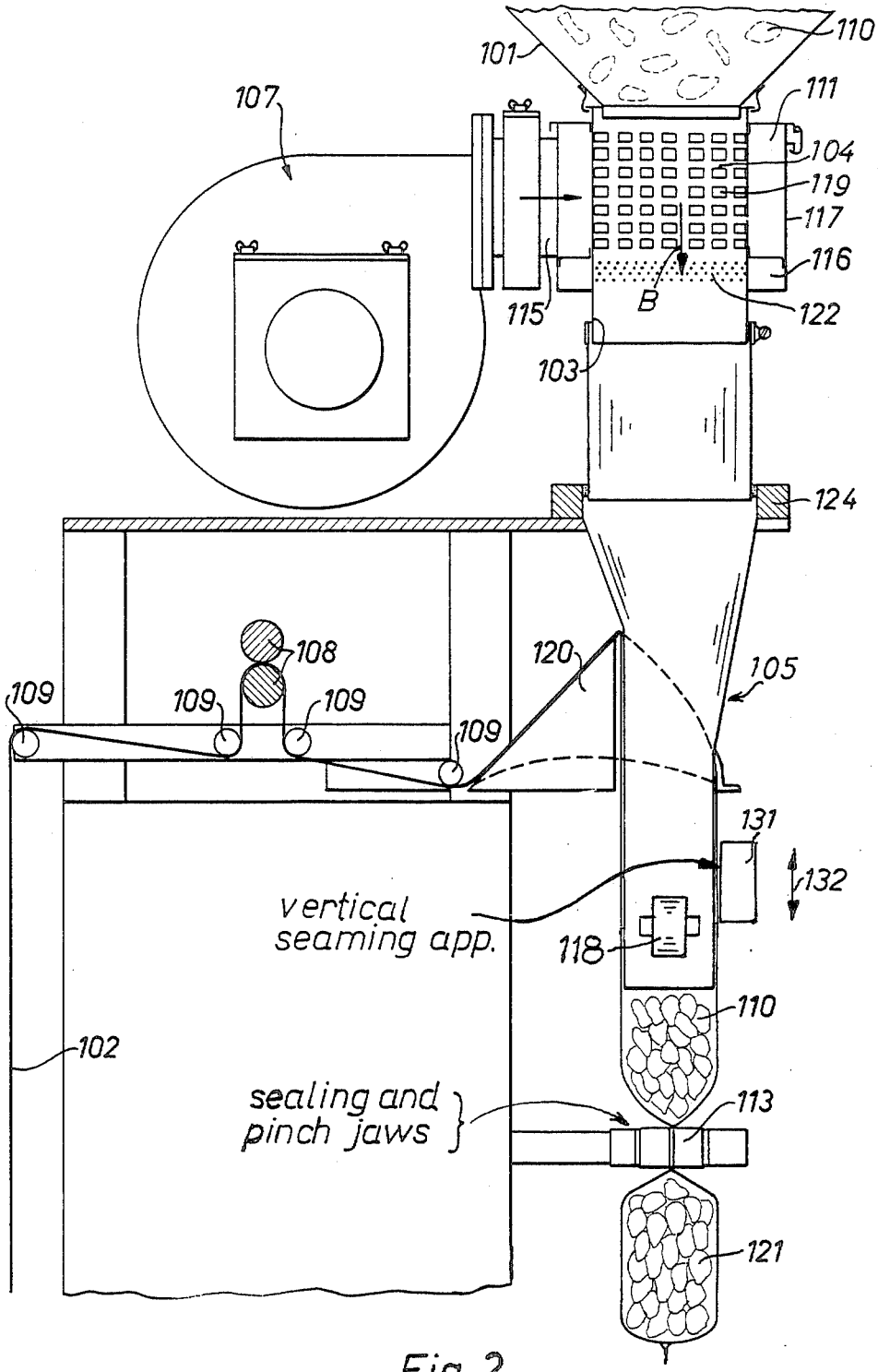
FIG. 2 is a schematic side view, in greater detail, illustrating the bag making-and-filling apparatus.
Figure 3:
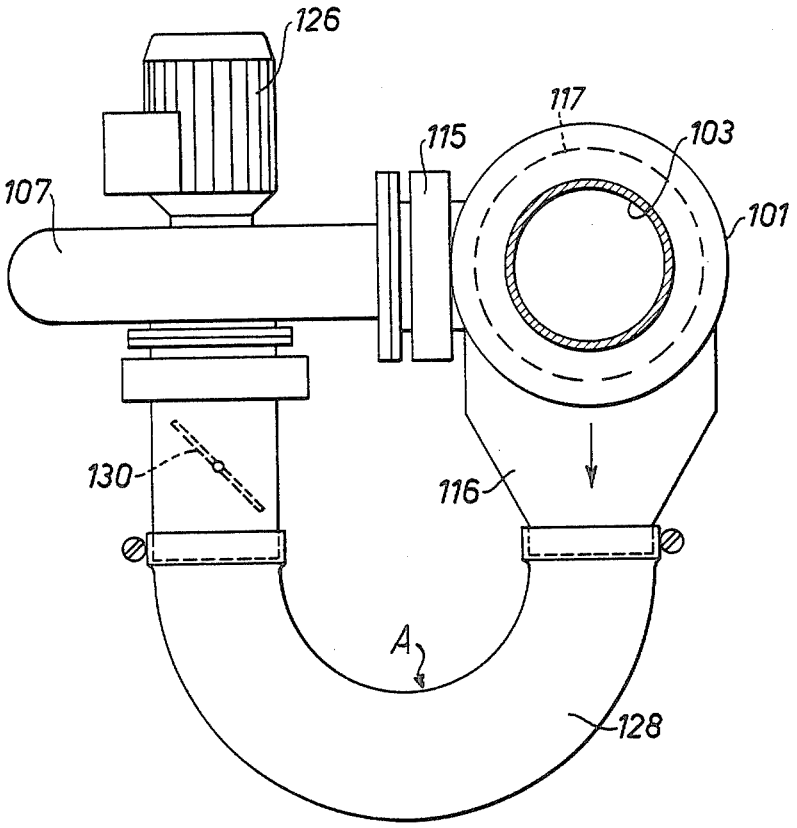
FIG. 3 is a top view and showing, schematically, the pneumatic connections of the tube filling portion of the machine.

Referring now to FIGS. 2 and 3, which show the structure in greater detail: a flexible foil 102 is guided over suitable guide rollers 109 and between a pair of transport rollers 108 which pull the foil 102, for example fill polyethylene foil, from a suitable supply roller; the transport rollers 108 may, also, apply printing or advertising material on the surface of the foil. The foil is then folded by forming shoulders 120 and wrapped around a forming and holder tube 105, which may be in several sections of different diameter, seamed vertically by the vertical seaming apparatus 131 to seal the side of a bag, still open at the top, shown schematically at 118. Sealing and pinch jaws 113, simultaneously, seal the top of the bag 121 which has just been formed, the bottom wall of a new bag, and sever the filled bag 121 from the still open newly formed bag 118. Vertical pull transport rollers 133 which provide vertical tension to the foil, as it is passed over the forming tube 105 have been shown only schematically, since such structures are known and described in the referenced application.

The fill good 110 is introduced into a wide conical funnel 101. This funnel has solid side walls, that is, conical walls, for example of sheet metal or sheet plastic, which are solid and not perforated.

Figure 5:
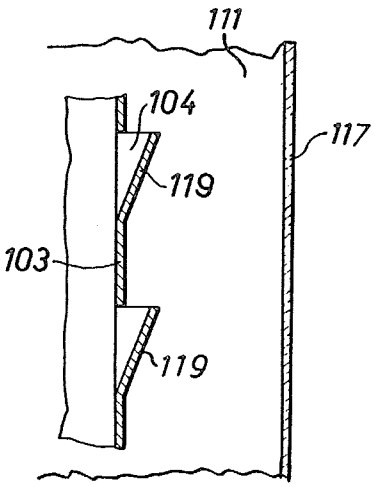
FIG. 5 is a sectional view along line V—V of FIG. 4, in line representation, illustrating the air inlet flaps.
Figure 4:
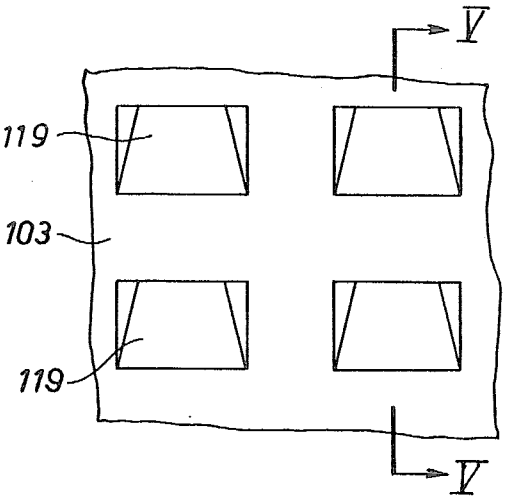
FIG. 4 is a fragmentary, developed side view showing air inlet flaps being formed in the filling tube.

In accordance with a feature of the invention, the funnel terminates in an essentially cylindrical tubular extension, of fill tube 103 within which a vertical air stream is generated, as shown by the arrow B. The essentially tubular extension 103 is surrounded by a jacket 117 which defines two chambers. An upper chamber 111 surrounds the upper portion of the fill tube 103; a lower chamber 116, separated by a ring from the upper chamber 111, surrounds a lower portion of the fill tube 103. The upper chamber 111 is in pneumatic, airflow communication with the interior of the fill tube 103 by openings 104, see also FIGS. 4 and 5, formed in the sidewall of the fill tube 103, for example by bending flaps 119 outwardly of the tube 103. At the top of each of the slanting flaps is an opening 104 so that air can flow from the upper chamber 111 in downward direction into the fill tube 103. The flaps 119, then, and extending preferably uniformly circumferentially around the fill tube and over their full height, will form inlet nozzles which direct airflow from the compressor 107, via a coupling 115 to the chamber 111, and into the fill tube.

Air which is introduced into the fill tube 103 must be removed, however, since, otherwise, it might interfere with the formation of the bag 118 which is to be formed therebelow. The fill tube 103, thus, is formed with further openings 122, downwardly, or downstream of the openings 104. The openings 122 may, for example, be a plurality of small punched-out openings, or a mesh portion of the tube 103, the outside of which is in pneumatic communication with the chamber 116. Chamber 116 is connected through a suitable duct 128 (FIG. 3) to a compressor 107, driven by a motor 126. Thus, a closed loop A, of air being introduced into the fill tube 103, and removed from the fill tube 103, is established. Except for air leakage, thus, the air removed is as much as the air being introduced. A control vane 130 is preferably included in the duct 128, as shown in FIG. 3.

FIG. 1 additionally shows a frame structure 24 which supports the tube forming shields, as well as the tube filling funnel 1, 101, as well as a fill hopper tube (FIG. 1). The frame may be of any suitable construction.

OPERATION

In accordance with the present invention, gravity fill or feed or goods or fill material 110 from the hopper tube and through the funnel 1 (FIG. 1) or in FIG. 2, 101 is accelerated, without damage to the fill goods, by the air stream B. Yet, since fill goods will be upstream of the point at which the air stream is generated, due to the presence of fill good 110 in the funnel 1, 101, the fill good will not have the tendency to "dance" or be blown upwardly unrestrictedly by possible excess air, or air which does not follow the punched-out downwardly directed nozzle flaps 119. Consequently, the fill good will be accelerated downwardly by the air stream only within the filling tube 103, the air then being removed—thus contributing to the generation of the air stream—by the suction openings 122 which terminate in the chamber 116, coupled to the inlet, or vacuum opening of the compressor or blower 107, or of an inlet portion of a suction apparatus 14 (FIG. 1).

In accordance with a feature of the invention, the filling tube 103 is a double wall structure, in other words, the tube is surrounded by the jacket 117 to form the circular chamber 111 between the two walls, namely the perforated wall of the tube 103 and the outer solid wall of the jacket. The inner wall of the tube 103 is formed with the air nozzles or openings 104. The shape of the flaps, which are downwardly directed also contributes to aligning and feeding the goods downwardly towards the bag 118 which is being formed around the forming tube 105. The bag forming tube 105 is preferably joined to the fill tube 103 by slightly flexible joint, for example including an O-ring, as schematically shown in FIG. 2; any other suitable construction may also be used (e.g., a well). Thus, air directed and introduced into the chamber 111 through the inlet flange 115 will be directed downwardly through the fill tube 103. Preferably, the fill tube is elongated, as shown in FIG. 2; the schematic showing in FIG. 1 has been compressed for space reasons. The flaps 119, located circumferentially about the tube, extend into the chamber 111 and the downwardly directed flaps 119, bent from within the tube, generate the downwardly directed air stream, in combination with the downstream suction removal through the openings 122 communicating with chamber 116.

Preferably, the chamber 116 includes internal airflow direction vanes, to separate airflow from the inlet coupling 115 to supply both circumferential halves of the fill tube 103 with air in uniformly distributed manner. More than one air inlet stub 115 may be provided. The respective flaps 119 of the nozzles 104 are so inclined that air entering from the chamber 111 receives a substantial speed vector component in downward direction. The flaps 119, preferably, form a acute angle which is rather small with respect to a vertical axis. A suitable bent angle—open to the top—with respect to the wall of the fill tube 103, is preferably about 15°.

The bag 118, being formed, can be filled as the bag is being made, that is, as foil is being fed downwardly by the rollers 108, pulled off by suitable pull-off rollers 113 and being seamed vertically and cross-sealed. Even if the tubular portion 118 is stationary, the throughput of the machine is substantially increased over machines without the airflow, since the filling rate, that is, the rate of fill of the goods 110 into the tube 118 is increased. The present invention, however, readily permits filling of the bag 118 as it is being made, that is, as the foil 102 is being seamed longitudinally and transversely. The jaws 113, preferably, may also be movable vertically, to pull down a bag as it is being made, sever the filled bag and then open and return to close off the just previously filled open tube, thus forming the closed bag, and bottom-seaming the tubular foil thereover. If necessary, the free fall of fill goods during the bottom sealing operation can be briefly interrupted by an interposed vane, or stop member, not shown, and of any suitable construction.

For some applications, it is not necessary that the air inlet openings are located all the way around the fill tube; it may be sufficient if the air inlet openings are located only around the upper region of the fill tube 103, with a solid portion interposed between the inlet nozzles 104 and the outlet openings 122.

Further it is possible that the nozzle flaps 119 are bent inwardly from the wall of the fill tube 103, whereby the openings 104 are then at the lower end of the inclined portion to provide downwardly directed nozzle openings and thus the air introduced into the chamber 111 will be directed downwardly through the fill tube 103. A suitable bent angle open downwardly with respect to the wall of the fill tube 103, is preferably about 15°.

Various changes and modifications may be made within the scope of the inventive concept.

I claim:

1. Tubular bag making-and-filling machine comprising a generally vertically extending bag holder tube (105) to hold a partly formed tubular bag, which is closed at the bottom, and open at the top, in essentially vertical position;

pinching and sealing jaws 9113) movably transversely of the bag to seal the bag after it has been filled;

a filling hopper (101) receiving fill goods (110), particularly fill goods of flaky, or individual lightweight particles;

an essentially cylindrical tubular extension fill tube (103) having an upper region, and a wall, said fill tube leading toward the open top of the bag (118) and directing the fill goods into the open top of the bag;

means (107) for generating an airflow (B) within the fill tube (103) in an essentially vertical direction to enhance movement of the fill goods (110) to be filled in to the bag;

means for forming an inlet air chamber (111) surrounding, at least the upper region of the fill tube (103);

an air inlet opening (115) terminating in said chamber (111) and coupled to said airflow generating means (107);

air directing nozzle flaps (119), bent from a wall of the fill tube (103) to form air directing openings (104) directing air from the chamber (111) into the fill tube (103), located in the upper region thereof, and shaped to provide downwardly directed flap nozzle openings;

means for forming an air removal chamber (116) surrounding the fill tube (103) and located downwardly of the air inlet openings (104);

air removal openings (122) formed in the wall of the fill tube below the air directing openings (104) and communicating with said air removal chamber;

a duct (128) coupling said air removal chamber to said airflow generating means, to remove air, by suction, from the interior of the fill tube (103) and to form a closed pneumatic loop;

the bag holder tube (105) being located below the fill tube (103) and being joined thereto;

and tube forming sheets or vanes (20, 120) receiving a deformable, sealable foil (102) to form the fill-receiving tubular bag (118), said tube forming sheets or vanes (20, 120) being located below the air removal openings formed in the fill tube, and directing said deformable foil to wrap about the bag holder tube (105).

2. The machine according to claim 1, wherein the fill hopper includes a funnel;

a transition zone is located between the funnel and the fill tube;

and the air directing nozzle flaps are located below the transition zone of the funnel (101) to the fill tube (3).

3. The machine according to claim 1, wherein the air directing openings (104) for generating airflow towards the tubular bag are located only in the fill tube (103) and below said funnel (101);

and the air removal outlet openings (122) are located in said fill tube substantially below said air inlet openings (104).

4. The machine according to claim 1, including feed rollers (108) coupled to and feeding said foil (102) about the bag holding tube (105) for forming a bag tube (118) as the tube is being filled by said fill goods, said fill goods being accelerated by the air flow in the fill tube (103).

5. The machine according to claim 1 wherein the means for generating the airflow within the fill tube comprises generating a continuous air flow.

6. The machine according to claim 5 wherein said nozzle flaps are bent from the wall of the fill tube outwardly into the air inlet chamber.

7. The machine according to claim 1 wherein said nozzle flaps are bent from the wall of the fill tube outwardly into the inlet air chamber.

8. In a tubular bag filling machine having means (105, 120, 131) for forming a tubular bag, which bag is open at the top and closed at the bottom, and means to hold the tubular bag with the open top in an upward direction, a filling funnel (1, 101) receiving fill goods, particularly of flaking or individual lightweight particles and directing the fill goods towards the bag, and an essentially vertically extending fill tube (103) having a longitudinallyaxis, a method to increase the fill speed, by gravity, of the fill goods and prevent "dancing" of the fill goods in the funnel, comprising the steps of generating an airflow or air stream downwardly from the funnel and directed toward the open top of the bag, without, however, introducing the airflow into the bag, including the steps of introducing air with overpressure into a fill tube, at a position located downwardly of the funnel (101) and directing said air at an angle with respect to the longitudinal axis of the fill tube within the fill tube;

removing the air by suction from the fill tube, at a position upwardly of the open top of the bag from the fill tube;

and circulating the removed air in a closed path (A) for reintroduction under overpressure of at least a portion of the removed air into the fill tube.

9. The method of claim 8, including the step of forming the bag by wrapping a foil (102) about a holder tube (105) which is joined to the fill tube (103) within which the air stream is generated.

10. The method of claim 8 wherein said step of generating an air flow or air stream comprises generating an essentially continuous air flow or air stream by introducing air with overpressure into the fill tube continuously; and the step of removing air comprises continuously removing the air by suction.

* * * * *